US006994280B2

(12) United States Patent
Kurz et al.

(10) Patent No.: US 6,994,280 B2
(45) Date of Patent: Feb. 7, 2006

(54) FUEL INJECTION DEVICE FOR INTERNAL COMBUSTION ENGINES

(75) Inventors: Michael Kurz, Gerlingen (DE); Gerd Wahr, Deckenpfronn (DE)

(73) Assignee: Robert Bosch GmbH, Stuttgart (DE)

( * ) Notice: Subject to any disclaimer, the term of this patent is extended or adjusted under 35 U.S.C. 154(b) by 58 days.

(21) Appl. No.: 10/296,705

(22) PCT Filed: Mar. 22, 2002

(86) PCT No.: PCT/DE02/01040

§ 371 (c)(1),
(2), (4) Date: May 19, 2003

(87) PCT Pub. No.: WO02/077443

PCT Pub. Date: Oct. 3, 2002

(65) Prior Publication Data

US 2003/0173427 A1 Sep. 18, 2003

(30) Foreign Application Priority Data

Mar. 28, 2001 (DE) ..... 101 15 325

(51) Int. Cl.

| | |
|---|---|
| ***F02M 59/00*** | (2006.01) |
| ***F02M 61/00*** | (2006.01) |
| ***F02M 63/00*** | (2006.01) |
| ***F02M 47/02*** | (2006.01) |
| ***B05B 1/00*** | (2006.01) |

(52) U.S. Cl. ..... 239/533.2; 239/533.3; 239/88; 239/600

(58) Field of Classification Search ..... 239/533.2, 239/533.3, 88, 600, 89–96, 533.4–533.12, 239/585.1–585.5; 251/366, 367; 123/470
See application file for complete search history.

(56) References Cited

U.S. PATENT DOCUMENTS

| | | | | |
|---|---|---|---|---|
| 5,718,386 | A * | 2/1998 | Haug | 239/533.9 |
| 5,746,181 | A | 5/1998 | Boecking et al. | |
| 6,053,432 | A * | 4/2000 | Stevens | 239/533.2 |
| 6,705,647 | B1 * | 3/2004 | Palmer | 285/261 |

FOREIGN PATENT DOCUMENTS

| | | |
|---|---|---|
| DE | 195 23 243 A1 | 1/1997 |
| DE | 197 05 227 A1 | 8/1998 |
| EP | 0 890 734 A2 | 1/1999 |
| EP | 0 985 821 A2 | 3/2000 |
| GB | 2 311 558 A | 10/1997 |
| GB | 2 340 885 A | 3/2000 |
| JP | 6-221258 | 9/1994 |

* cited by examiner

*Primary Examiner*—David A. Scherbel
*Assistant Examiner*—Darren Gorman
(74) *Attorney, Agent, or Firm*—Ronald E. Greigg

(57) ABSTRACT

A fuel injector for internal combustion engines, includes a base body, an injection housing and a fastening device. The fastening device includes at least one lock nut with an annular land and an annular shoulder on the injection housing. By means of the fastening device, the injection housing is braced axially against the base body. A fuel inlet and at least one valve element are also provided. To improve the seal between the base body and the injection housing, the fastening device has at least one annular face which is oriented toward the annular land of the lock nut and is curved convexly in the manner of a spherical-segmental face.

19 Claims, 5 Drawing Sheets

FUEL INJECTION DEVICE FOR INTERNAL COMBUSTION ENGINES

CROSS-REFERENCE TO RELATED APPLICATIONS

This application is a 35 USC 371 application of PCT/DE 02/01040 filed on Mar. 22, 2002.

BACKGROUND OF THE INVENTION

1. Field of the Invention

The invention relates to a fuel injection device, in particular an injector, for internal combustion engines, having a base body, having an injection housing, having a fastening device which includes at least one lock nut with an annular land and an annular shoulder on the injection housing and which braces the injection housing axially against the base body, having a fuel inlet, and having at least one valve element.

2. Description of the Prior Art

One fuel injection device of the type with which this invention is concerned is known from German Patent Disclosure DE 197 29 843 A1. This reference shows a fuel injection valve for internal combustion engines which has a lock nut that rests with an inner, conically embodied annular land on an annular shoulder of an injection housing. In this way, the injection housing is braced against the base body. The annular shoulder, on its side toward the annular land, is embodied in curved form, in such a way that at a predetermined spacing from the longitudinal axis of the fuel injection device, a support point extending annularly all the way around, on which the conical annular land rests in the installed state, is created.

The object of the present invention is, in a fuel injection device of the type defined at the outset, to improve the seal between the injection housing and the base body. Moreover, the deviations in the injection quantity are to be reduced. In addition, because of the uniform axial bracing, wear of the nozzle needle guide and at the nozzle needle seat are reduced.

This object is attained, in a fuel injection device of the type defined at the outset, by providing that the fastening device has at least one annular face which is oriented toward the annular land of the lock nut and is curved convexly in the manner of a spherical-segmental face.

SUMMARY AND ADVANTAGES OF THE INVENTION

According to the invention, it has been found that certain leaks between the injection housing and the base body can occur because the contact pressure at the contact face between the base body and the injection housing does not have a uniform course. If there are points where the contact pressure is only slight, then the sealing at these points is also only relatively slight. At other points, conversely, force peaks can occur that cause deformation of the injection housing. This in turn can cause deviations in the injection quantity from one fuel injection device to another. The reason for the uneven force distribution is the variations in axial eccentricity, on the one hand in the thread on the body of the base body and on the other in the thread of the lock nut itself.

In the fuel injection device of the invention, such non-uniformity in the axial clamping force between the base body and injection housing are largely avoided. This is achieved by providing that, because there is a spherical-segmental face, the injection housing automatically aligns itself upon assembly in such a way that the force is distributed substantially uniformly over the circumference of the fastening device. That is, because of the spherical-segmental face, a function on the order of a ball and socket joint is furnished, which enables automatic, optimal alignment of the injection housing relative to the base body upon assembly of the fuel injection device.

Since the pressure per unit of surface area in the region of contact between the base body and the injection housing is made uniform, the likelihood that leaks will occur in this region of contact becomes less. Moreover, the likelihood of deformation of the injection housing is also lower, and thus the injection quantity varies less—if at all—from one fuel injection device to another.

Advantageous refinements of the invention are disclosed in dependent claims.

In a first refinement, the fastening device includes a concave spherical-segmental face which is complementary to the convex spherical-segmental face and on which the convex spherical-segmental face rests over a large surface area. This creates a kind of "ball-and-socket joint". In that case, the alignment of the injection housing relative to the base body upon assembly of the fuel injection device is accomplished with especially little force and especially easily. This leads to an especially uniform pressure per unit of surface area at the connection point between the base body and the injection housing.

However, it is also possible for the fastening device to have an oblique, flat annular face, which is oriented toward the convex spherical-segmental face and on which the spherical-segmental face rests linearly. This kind of oblique annular face is easy to produce and makes economical production of the fuel injection device of the invention possible.

It is especially preferred that the oblique annular face forms an angle of approximately 120°. At such an angle, the axial forces required for a secure connection and a secure seal are still transmitted well, while on the other hand an oblique face of this kind offers a good seat for the convex spherical-segmental face.

It is especially preferred if the fastening device includes an annular disk, which is disposed between the injection housing and the lock nut, and if either the convex spherical-segmental face or the concave spherical-segmental face or the oblique annular face is embodied on the annular disk. An annular disk of this kind makes it possible for instance to use a conventional lock nut, which keeps the production cost of the fuel injection device of the invention low. As an alternative, however, the injection housing may also have a conventional annular shoulder, on which there is then neither an oblique face nor a spherical-segmental face, if the annular disk of the invention is provided.

It is preferable, however, if the convex spherical-segmental face is embodied on the annular shoulder of the injection housing. The injection housing is already a complex part, for which the additional machining step entails only comparatively little additional expense.

The alignment of the injection housing relative to the base body is simplified still further if the convex spherical-segmental face and either the concave spherical-segmental face cooperating with it, or the oblique annular face, are provided with a low-friction coating, preferably of Teflon.

BRIEF DESCRIPTION OF THE DRAWINGS

Exemplary embodiments of the invention are described in detail below in conjunction with the drawings, in which.

DESCRIPTION OF THE PREFERRED EMBODIMENTS

Figure 1:
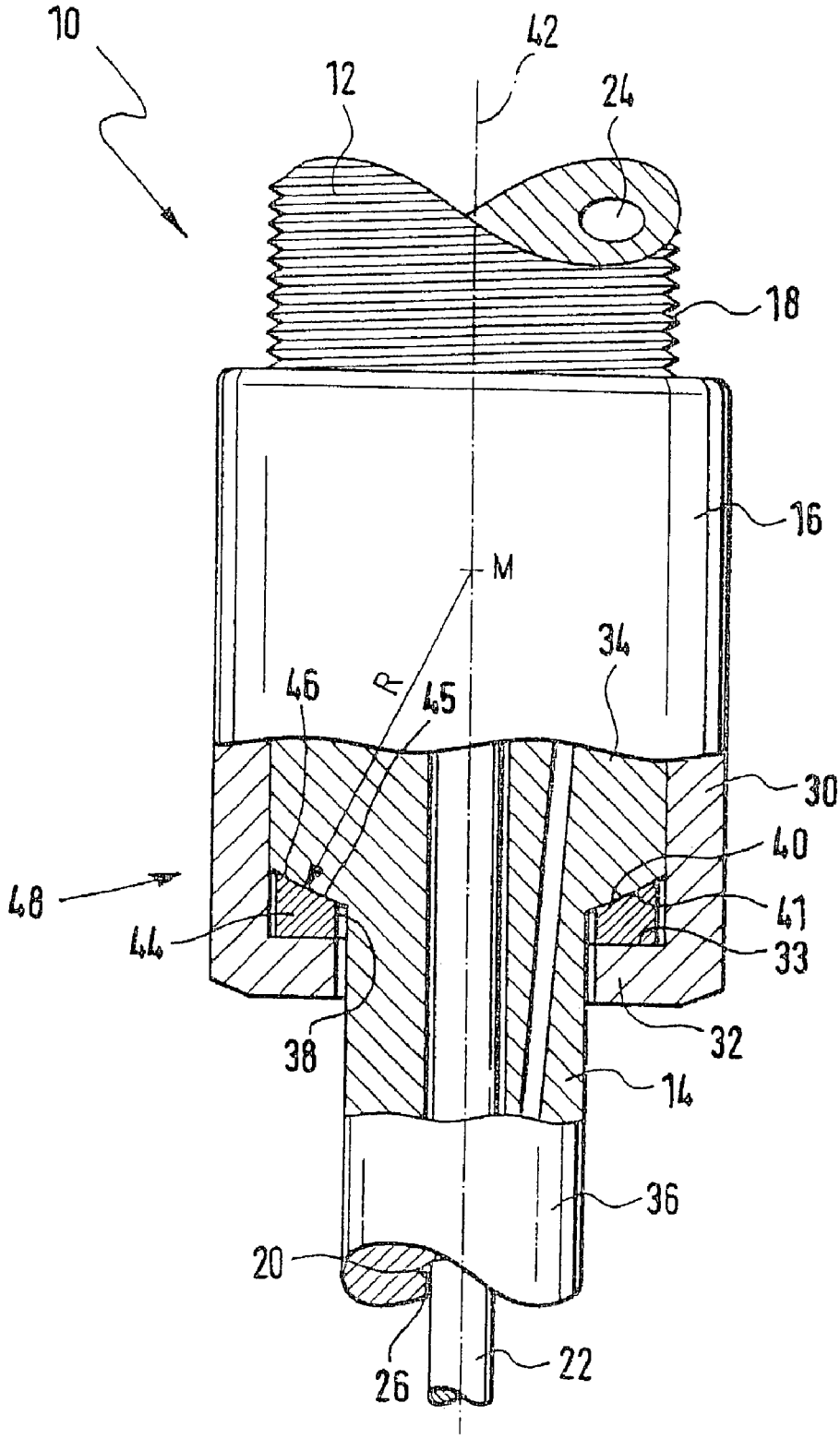
FIG. 1 is a fragmentary longitudinal section through a first exemplary embodiment of a fuel injection device, with a lock nut and an annular disk.

In FIG. 1, a fuel injection device is identified as a whole by reference numeral 10. It includes a base body 12, an injection housing 14, and a lock nut 16. On the base body 12, there is a thread 18 that the lock nut 16 is screwed onto. In the injection housing 14 is a bore or recess 20, extending longitudinally of the injection housing, and a valve needle 22 is disposed in it. A fuel inlet 24 supplies fuel to an annular chamber 26 between the valve needle 22 and the inner surface of recess 20. By means of an axial motion of the valve needle 22, fuel outlet openings, not shown in the drawing, can be made to communicate with the annular chamber 26, so that fuel is dispensed from the fuel injection device 10.

The fuel injection device 10 serves in general to inject fuel directly into the combustion chamber of an internal combustion engine. Either gasoline or Diesel fuel can be injected with it.

Figure 5:
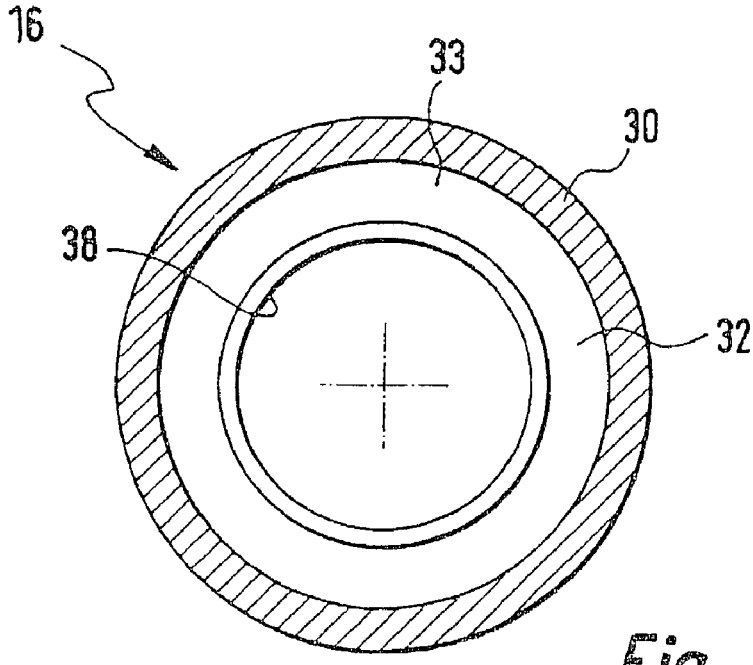
FIG. 5, a section taken along the line V—V in FIG. 4.
Figure 3:
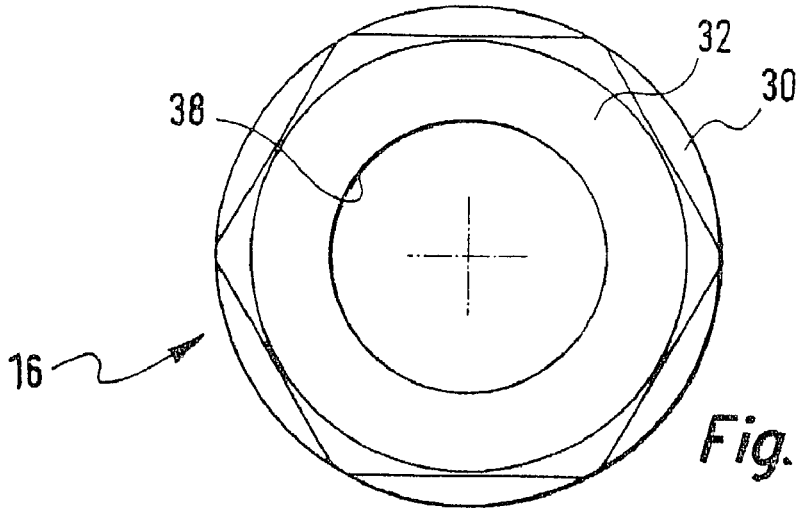
FIG. 3, a top view of the lock nut of the fuel injection device of FIG. 1.
Figure 4:
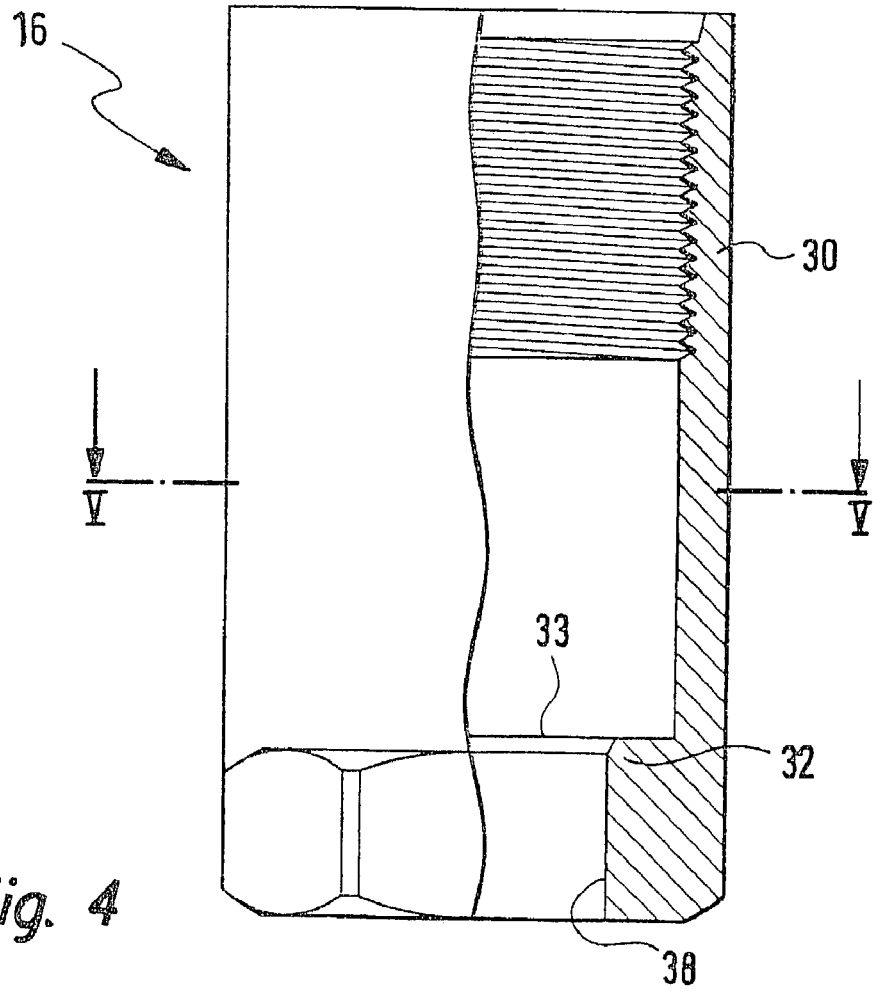
FIG. 4, a fragmentary longitudinal section and side view of the lock nut of the fuel injection device of FIG. 1.

The lock nut 16 (see FIGS. 3–5) is a hollow-cylindrical part, which has a wall portion 30 and, formed onto the lower end thereof in terms of FIG. 1, a radially inward-pointing annular land 32. The upper surface 33, in terms of FIG. 1, of the annular land 32 and the inner surface of the wall portion 30 are at an angle of approximately 90° to one another.

The injection housing 14 has one portion 34 of larger diameter and one portion 36 of smaller diameter. The diameter of the smaller-diameter portion 36 is somewhat less than the diameter of the opening 38 defined by the annular land 32 of the lock nut 16. The diameter of the portion 34 of the injection housing 14 is somewhat less than the inside diameter of the wall portion 30 of the lock nut 16.

Between the portions 34 and the portion 36 of the injection housing 14, an annular shoulder 40 is formed. The annular shoulder 40 is curved convexly, in the manner of a spherical-segmental face 41. The radial center point M of the spherical-segmental face 41 is located on the longitudinal axis 42 of the fuel injection device 10. The radius of the sphere from which the spherical-segmental face 41 has been cut is R.

Figure 2:
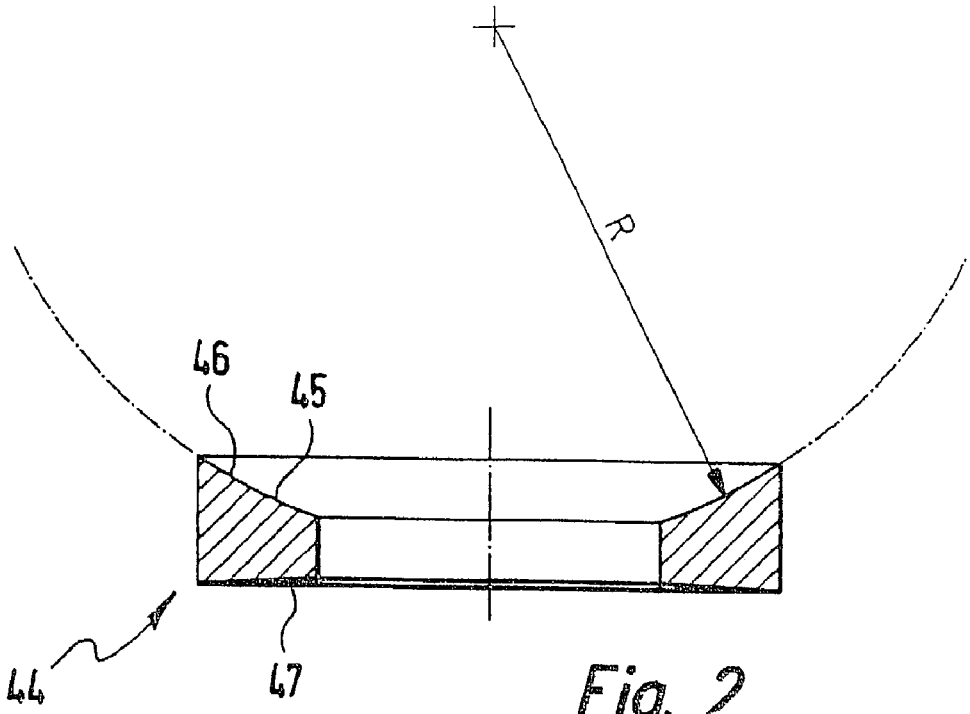
FIG. 2, a section through the annular disk of the fuel injection device of FIG. 1.

Between the annular land 32 of the lock nut 16 and the annular shoulder 40 on the injection housing 14, there is an annular disk 44 (see FIG. 2). The inside diameter of the annular disk 44 is somewhat greater than the outside diameter of the portion 36 of the injection housing 14, while conversely the outside diameter of the annular disk 44 is somewhat less than the inside diameter of the wall portion 30 of the lock nut 16. The top 45 of the annular disk 44 is embodied as a concave spherical-segmental face 46, to which the convex spherical-segmental face 41 on the injection housing 14 is complementary. The bottom 47 of the annular disk 44 has a conical indentation.

The radius of the sphere from which the concave spherical-segmental face 46 is cut is thus also R, and the radial center point M of this sphere is likewise located on the longitudinal axis 42 of the fuel injection device 10. Both spherical-segmental faces 41 and 46 are provided with a low-friction Teflon coating (not shown). The spherical-segmental faces 41 and 46 thus cooperate in the manner of a ball-and-socket joint. The annular shoulder 40 on the injection housing 14, the lock nut 16 with the annular land 32, and the annular disk 44 together form a fastening device 48.

The assembly of the fuel injection device 10 by means of the fastening device 48 proceeds as follows:

First, the annular disk 44 is slipped from below over the portion 36 of the injection housing 14. The concave spherical-segmental face 46 of the annular disk 44 now points upward, or in other words toward the annular shoulder 40 of the injection housing 14. Next, the lock nut 16 is slipped onto the injection housing 14, with the annular land 32 disposed at the bottom. The lock nut 16 is then screwed to the thread 18 on the base body 12.

In this process, a region of the injection housing 14 that is hidden in FIG. 1 by the lock nut 16 comes into contact with a region of the base body 12 that is likewise hidden in FIG. 1. Optionally, there may also be a sealing element, such as an O-ring, between the two parts. When the lock nut 16 is tightened on the base body 12, the injection housing 14 aligns itself relative to the base body 12 in such a way that the pressure per unit of surface area at the sealing face between the injection housing 14 and the base body 12 is approximately uniform.

This is possible because the spherical-segmental face 46 on the one hand and the spherical-segmental face 41 on the other cooperate in the manner of a ball-and-socket joint, and hence the axial alignment of the lock nut 16 and the axial alignment of the injection housing 14 are decoupled from one another. Variations in axial eccentricity on the thread 18 of the base body 12 and on the female thread, not visible in FIG. 1, of the lock nut 16 thus no longer have any effect on the alignment of the injection housing 14.

A second exemplary embodiment of the fuel injection device, which is shown in FIGS. 6–9, will now be described. Those parts and elements that have functions equivalent to those in the fuel injection device shown in FIGS. 1–5 are identified by the same reference numerals and are not described again in detail below. The parts of this embodiment which are slightly different from the first embodiment are designated with a prime (') number.

Figure 6:
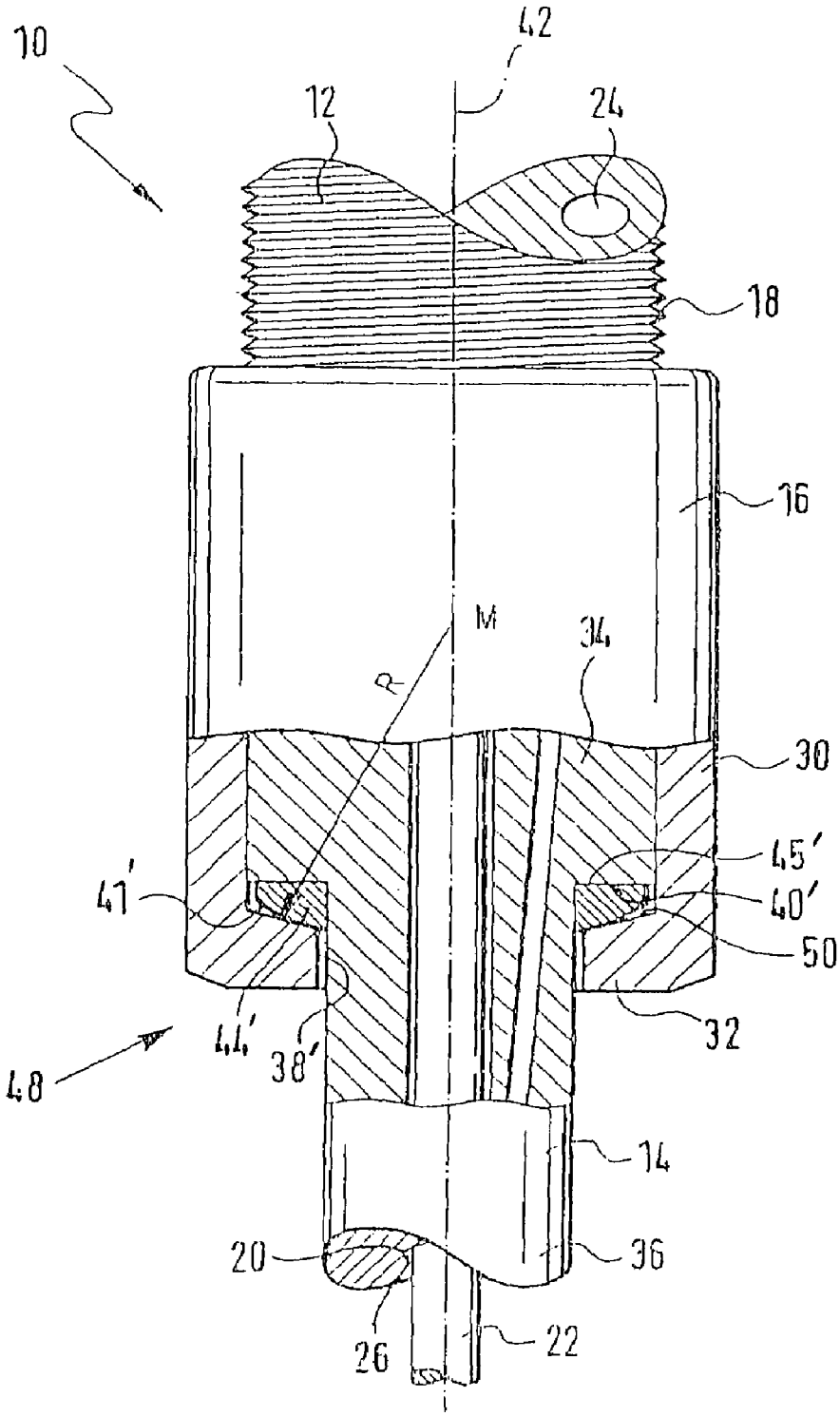
FIG. 6, a view similar to FIG. 1 of a second exemplary embodiment of a fuel injection device, with a lock nut and an annular disk.
Figure 8:
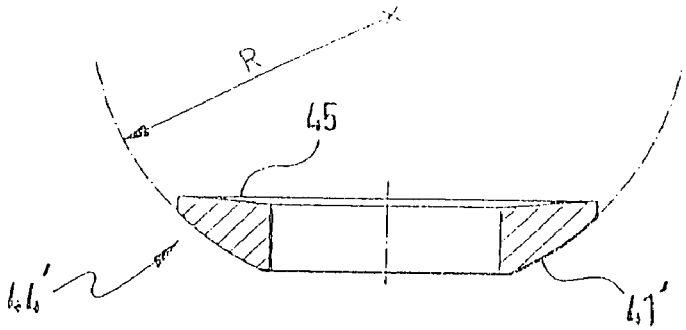
FIG. 8, a section taken along the line IX—IX of FIG. 7.
Figure 7:
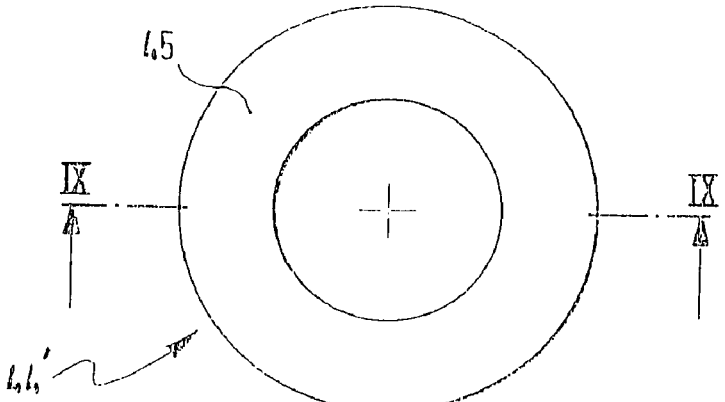
FIG. 7, a top view on the annular disk of the fuel injection device of FIG. 6.
Figure 9:
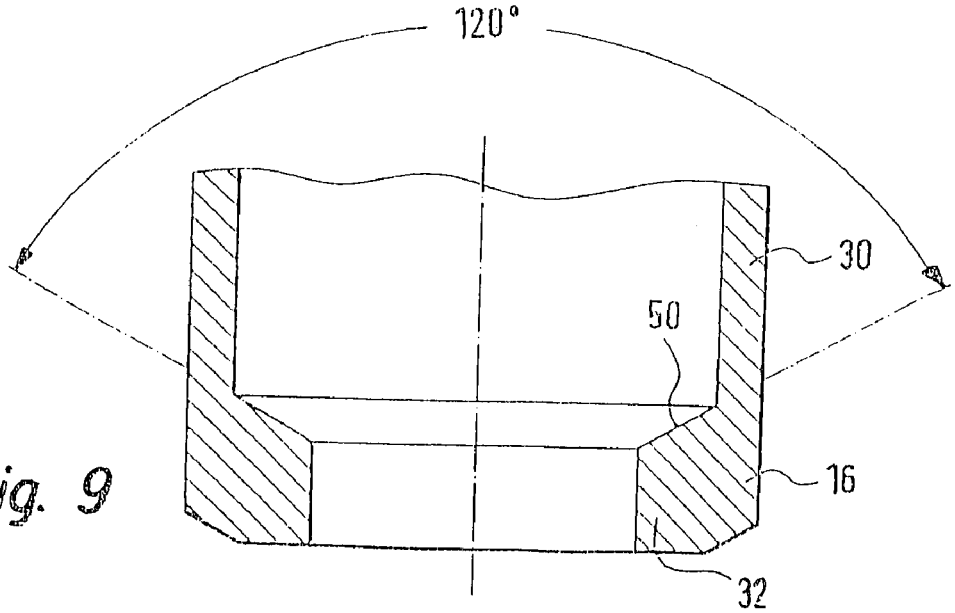
FIG. 9, a longitudinal section through a region of the lock nut of the fuel injection device of FIG. 6.

Unlike the fuel injection device 10 shown in FIGS. 1–5, the surface of the annular land 32 of the lock nut 16 pointing upward in FIG. 6 is embodied as an oblique annular face 50. The oblique annular face 50 forms an angle of approximately 120° (see FIG. 9). The annular shoulder 40' of the injection housing 14 in this exemplary embodiment is not convexly curved; instead, it extends from the portion 36 of smaller diameter of the injection housing 14 in a straight line and radially outward at an angle of approximately 90°. Once again, on its underside, the annular disk 44' has an annular face, which is curved convexly in the manner of a spherical-segmental face 41. The top 45 of the annular disk 44' has an indentation.

In the exemplary embodiment shown in FIGS. 6–9, the decoupling of the alignment of the lock nut 16 on the one hand and the alignment of the injection housing 14 on the other is accordingly attained by means of the oblique annular face 50 and the contact face 41 that cooperates with it.

The foregoing relates to preferred exemplary embodiment of the invention, it being understood that other variants and embodiments thereof are possible within the spirit and scope of the invention, the latter being defined by the appended claims.

We claim:

1. A fuel injection device (10) for internal combustion engines, comprising a base body (12), an injection housing (14), a fastening device (48) which includes at least one lock nut (16) with an annular land (32) and an annular shoulder on the injection housing (14) and which braces the injection housing (14) axially against the base body (12), a fuel inlet (24), and at least one valve element (22), the fastening device (48) having at least one annular face which is oriented toward the annular land (32) of the lock nut (16), said at least one annular face being a convexly curved spherical-segmental face, the spherical-segmental face having a center point (M) located on a longitudinal axis (42) of the fuel injection device (10).

2. The fuel injection device (10) of claim 1, wherein the fastening device (48) comprises a concave spherical-segmental face (46) which is complementary to the convex spherical-segmental face and on which the convex spherical-segmental face rests over a large surface area.

3. The fuel injection device (10) of claim 1, wherein the fastening device (48) comprises an oblique, flat annular face (50), which is oriented toward the convex spherical-segmental face and on which the spherical-segmental face rests linearly.

4. The fuel injection device (10) of claim 3, wherein the oblique annular face (50) forms an angle of approximately 120°.

5. The fuel injection device (10) of claim 1, wherein the fastening device (48), further comprises an annular disk disposed between the injection housing (14) and the lock nut (16), and wherein the convex spherical-segmental face is embodied on the annular disk.

6. The fuel injection device (10) of claim 3, wherein the fastening device (48), further comprises an annular disk disposed between the injection housing (14) and the lock nut (16), and wherein the convex spherical-segmental face is embodied on the annular disk.

7. The fuel injection device (10) of claim 4, wherein the fastening device (48), further comprises an annular disk disposed between the injection housing (14) and the lock nut (16), and wherein the convex spherical-segmental face is embodied on the annular disk.

8. The fuel injection device (10) of claim 1, wherein the convex spherical-segmental face is embodied on the annular shoulder of the injection housing (14).

9. The fuel injection device (10) of claim 2, wherein the convex spherical-segmental face is embodied on the annular shoulder of the injection housing (14).

10. The fuel injection device (10) of claim 1, wherein the convex spherical-segmental face and either a concave spherical-segmental face (46) which cooperates with it, or an oblique annular face (50) that cooperates with it, are provided with a low-friction coating.

11. The fuel injection device (10) of claim 2, wherein the convex spherical-segmental face and the concave spherical-segmental face (46) which cooperates with it, are provided with a low-friction coating.

12. The fuel injection device (10) of claim 3, wherein the convex spherical-segmental face and the oblique annular face (50) that cooperates with it, are provided with a low-friction coating.

13. The fuel injection device (10) of claim 4, wherein the convex spherical-segmental face and the oblique annular face (50) that cooperates with it, are provided with a low-friction coating.

14. The fuel injection device (10) of claim 1, wherein the convex spherical-segmental face and either a concave spherical-segmental face (46) which cooperates with it, or an oblique annular face (50) that cooperates with it, are provided with a low-friction coating made of polytetrafluoroethylene.

15. The fuel injection device (10) of claim 2, wherein the convex spherical-segmental face and the concave spherical-segmental face (46) which cooperates with it are provided with a low-friction coating made of polytetrafluoroethylene.

16. The fuel injection device (10) of claim 3, wherein the convex spherical-segmental face and the oblique annular face (50), that cooperates with it are provided with a low-friction coating made of polytetrafluoroethylene.

17. The fuel injection device (10) of claim 4, wherein the convex spherical-segmental face and the oblique annular face (50), that cooperates with it are provided with a low-friction coating made of polytetrafluoroethylene.

18. The fuel injection device (10) of claim 2, wherein the fastening device (48), further comprises an annular disk disposed between the injection housing (14) and the lock nut (16), and wherein the concave spherical-segmental face (46) is embodied on the annular disk.

19. The fuel injection device (10) of claim 1, wherein the fastening device (48), further comprises an annular disk disposed between the injection housing (14) and the lock nut (16), and wherein annular disk includes a concave spherical-segmental face (46).

* * * * *